United States Patent [19]

Wigdahl

[11] Patent Number: 4,505,254

[45] Date of Patent: Mar. 19, 1985

[54] WATER HEATER FOR DIVERS AND FOR OTHER USES

[76] Inventor: Arthur G. Wigdahl, 107 Dillard St., New Iberia, La.

[21] Appl. No.: 479,994

[22] Filed: Mar. 29, 1983

[51] Int. Cl.[3] ..... F24B 9/00

[52] U.S. Cl. ..... 126/367; 126/368; 126/360 R; 122/14; 122/95 R; 219/319; 219/378

[58] Field of Search ..... 126/204, 367, 362, 368, 126/360 R; 122/15, 95 R, 22, 23, 368, 13 R, 14; 110/234, 188, 309; 237/16, 17, 18, 56, 57, 59, 62; 219/316, 319, 378; 165/140, 104.19, 163, 164

[56] References Cited

U.S. PATENT DOCUMENTS

| | | | |
|---|---|---|---|
| 662,098 | 11/1900 | Schoenwetter et al. | 126/367 |
| 1,375,533 | 4/1921 | Myers | 126/360 R |
| 1,522,943 | 1/1925 | Calhoun | 126/368 |
| 2,698,616 | 1/1955 | Kudobe | 126/360 R |
| 3,527,260 | 8/1968 | Kimmel | 126/360 R X |
| 3,762,392 | 10/1973 | Long | 126/210 |
| 3,802,397 | 4/1974 | Wariner | 126/360 R X |
| 4,360,003 | 11/1982 | Hardy | 126/368 |
| 4,390,305 | 6/1983 | Sloan | 126/210 X |
| 4,393,814 | 7/1983 | Sievert | 122/22 |
| 4,418,649 | 12/1983 | Purvis | 122/15 |

*Primary Examiner*—Randall L. Green
*Attorney, Agent, or Firm*—B. P. Fishburne, Jr.

[57] ABSTRACT

An unpressurized heater for water or another liquid includes a shell which may be substantially filled with liquid to be heated and within which is immersed a fire box which delivers hot combustion products through fire tubes above the fire box which are themselves surrounded by the liquid contained in the shell. The fire box may be fired by gaseous, liquid or solid fuel. A secondary heat exchanger or heat exchangers within the shell also immersed in the liquid can receive salt water or other fluid which is heated proportionally to the temperature of the liquid in the shell and is circulated through a diver's suit and is ultimately returned to the sea after warming the diver. Back-up heating elements are included for diver applications along with required controls and instrumentation in dry compartments. Built-in fuel storage tanks complete a self-contained system.

2 Claims, 5 Drawing Figures

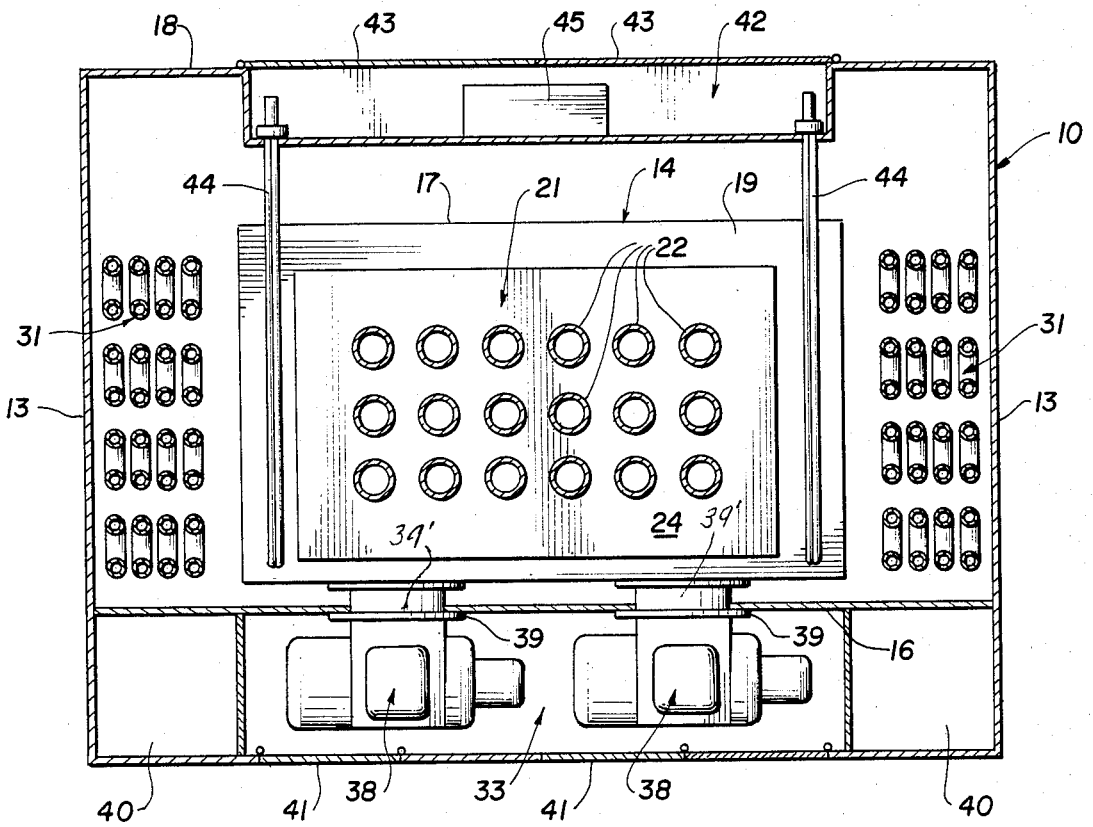
FIG. 3
FIG. 4
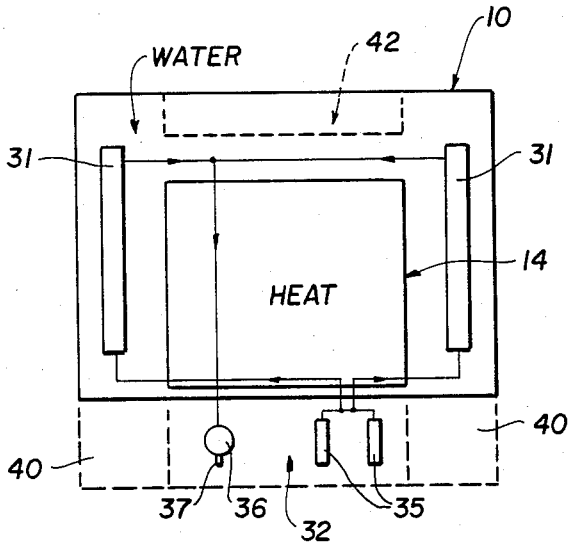
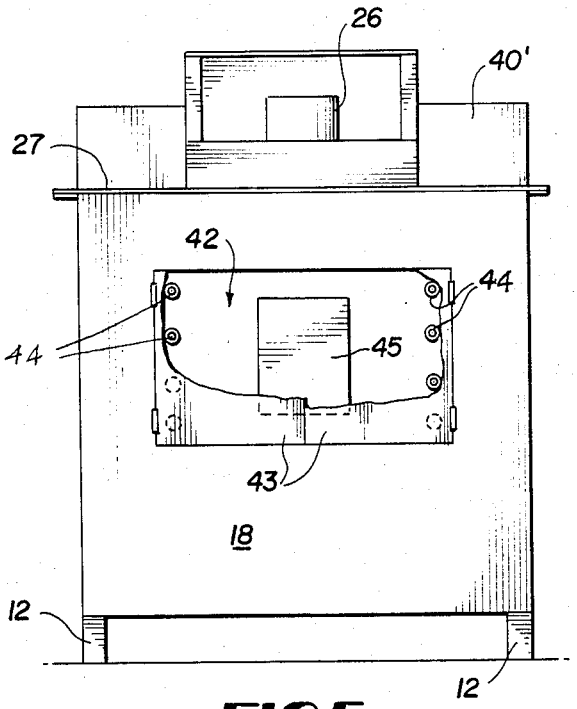
FIG. 5

WATER HEATER FOR DIVERS AND FOR OTHER USES

BACKGROUND OF THE INVENTION

This invention relates to a liquid heating system of general and diverse utility and particularly to a shipboard water or other liquid heating system for deep sea divers and the like. The invention has come into being as the direct result of a longstanding unsatisfied need for a safer, more efficient and simpler heating system for divers possessing adequate back-up safeguards.

Water heating arrangements for divers are known, one example being disclosed in U.S. Pat. No. 3,762,392. It is an object of the present invention to improve on the arrangement in this patent and the prior art in general.

In its essence, the present invention is embodied in an unpressurized shell or tank which may be substantially filled with water or other liquid to be heated for diverse uses at remote locations. Within the shell and substantially immersed in the liquid therein is a combustion chamber or firebox preferably having a dry bottom which may burn solid, gaseous or liquid fuels. Atop the firebox in direct communication therewith is an array of rising fire tubes which are surrounded by and exposed to the liquid filling the shell, thereby forming a primary heat exchanger. Above the fire tubes, a combustion products exhaust arrangement is provided which may be partly immersed in the liquid within the shell. The resulting liquid heater can be used for diverse applications with or without secondary immersed heat exchangers through which another fluid or fluids may be circulated by the operation of conventional means.

Other important objects and features of the invention will become apparent to those skilled in the art during the course of the following detailed description.

BRIEF DESCRIPTION OF THE DRAWINGS

FIG. 3 is a horizontal section taken on line 3—3 of FIG. 2.

FIG. 4 is a schematic plan view of the system as employed for divers.

FIG. 5 is a rear elevation of the heating unit.

DETAILED DESCRIPTION

Figure 2:
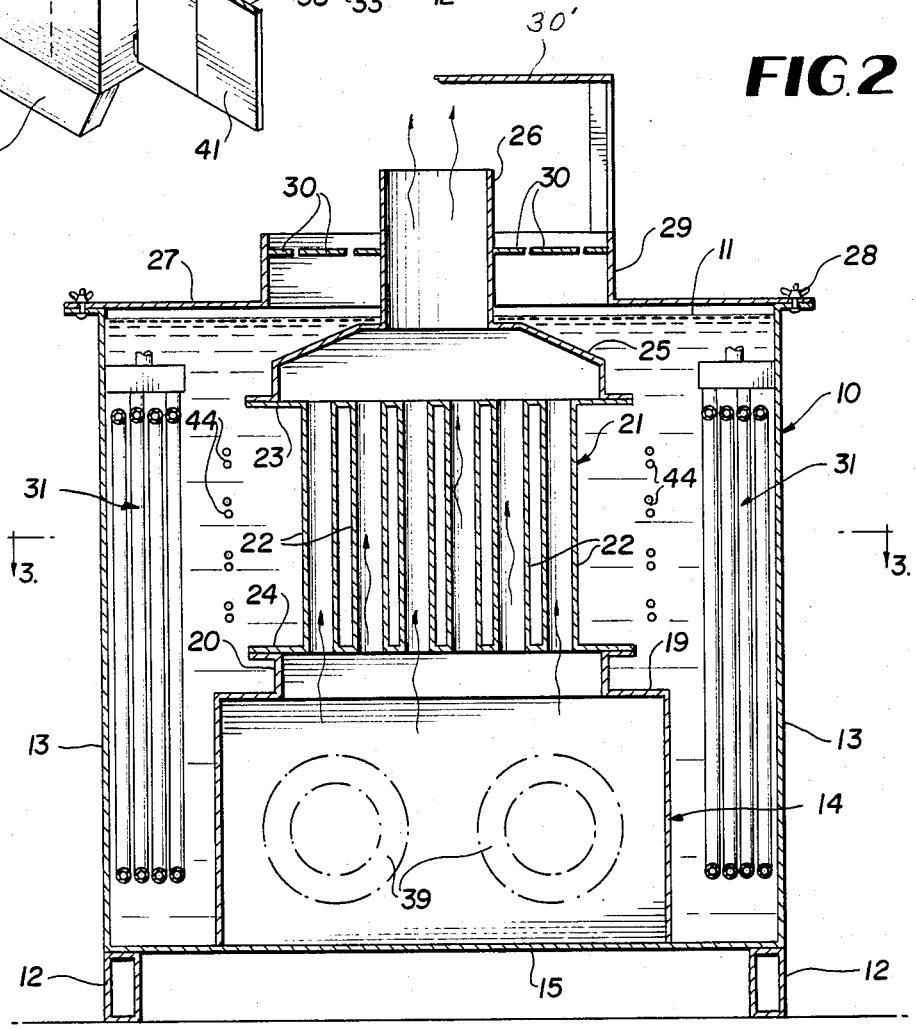
FIG. 2 is a vertical section looking rearwardly taken substantially on line 2—2 of FIG. 1.

Referring to the drawings in detail wherein like numerals designate like parts, a rectangular steel casing or shell 10, which may be thermally insulated, is filled with fresh water or another thermal transfer liquid, such as glycol, to the approximate level 11, FIG. 2. Preferably, the shell 10 has attached skids 12 to protect the bottom wall of the unit from deck water on a ship, and to facilitate handling by a forklift truck.

Fixed within the shell 10 midway between its two side walls 13 is a rectangular firebox 14 which shares the bottom wall 15 of the shell 10. As best shown in FIG. 3, a vertical water-tight bulkhead 16 extends between the shell side walls 13 and defines the front of the fresh water chamber of the unit. The bulkhead 16 is spaced slightly forwardly of the front wall of the firebox 14 to form an intervening liquid-filled space. The rear wall 17 of the firebox is spaced forwardly of the rear parallel wall 18 of shell 10. The top wall 19 of the firebox is at a level well above the bottom wall 15. The firebox 14 is thus surrounded by liquid on all sides and at its top. Only its bottom wall is a dry wall.

There is no necessity for any refractory lining of the firebox due to its immersion in liquid, which prevents warping of its walls. The dry bottom wall 15 of the firebox promotes rapid ignition and more complete burning of oil or other fuel in the firebox. In this connection, the device may utilize liquid, gaseous or solid fuels, depending upon availability, convenience and the particular application of the heating unit.

A relatively shallow adapter sleeve 20 rises from the top of the firebox 14 and is in open communication with its combustion chamber. On top of this adapter sleeve is fixedly mounted a primary heat exchanger assembly 21 consisting of a unitized group of open-ended vertical axis fire tubes 22, preferably arranged in three spaced parallel transverse rows of six fire tubes each and six spaced front-to-back parallel rows of three tubes each, FIG. 3. Different numbers of fire tubes in a different configuration and size may be employed in some cases. The open top and bottom ends of the fire tubes are united with horizontal flange plates 23 and 24, as shown.

The lower flange plate 24 is fixed to the adapter sleeve 20, and the top flange plate 23 is similarly fixed to the bottom of a heat exchanger cap or hood 25 which leads upwardly to and communicates directly with an exhaust stack 26 for gaseous combustion products rising from the fire tubes 22. The primary heat exchanger 21 including all of the fire tubes 22 and the cap 25 are submerged in the water or other liquid contained in the shell 10 and therefore are in direct heat transfer relationship with such liquid.

The top wall of the shell 10 is preferably in the form of a detachable and removable plate 27 held in place by fastening means 28, thereby allowing ready access at required times to the interior of the heating unit. A short sleeve extension 29 rises above the removable top wall 27 and is united therewith in spaced surrounding relationship to the exhaust stack 26. The interior of the shell 10 is vented to atmosphere by a series of spaced splash plates 30 fixedly held within the sleeve 29. In this connection, the liquid heating unit is completely unpressurized device, distinguishing it from a classic boiler which is a pressurized device. The splash plates 30 prevent the liquid contained in the shell 10 from splashing out of the top of the unit when a ship carrying it is in rough water, as with diver utilization of the invention. Preferably, a rain cover 30' is provided above the exhaust stack 26, and a heat baffle, not shown, may be placed in the area between the stack 26 and forward fuel tanks.

In connection with diver utilization, preferably a pair of secondary heat exchangers 31 in the form of finned copper tubing coils are supported in a submerged state in the liquid chambers at the opposite sides of firebox 14 and between the firebox and shell side walls. The secondary heat exchanger coils, as best shown in FIG. 2, may extend vertically for the major portion of the height of the shell 10. In the front-to-back direction, FIG. 3, the secondary heat exchanger coils extend at least along the two opposite side walls of the firebox 14 and may extend rearwardly of the firebox, if desired. The secondary heat exchangers could, in some cases, be located at other locations within the shell 10 instead of the two side positions illustrated. In still other cases, only a single secondary heat exchanger may be utilized, or more than two secondary heat exchangers could be used, if desirable.

In diver utilization of the invention, sea water is pumped through the secondary heat exchanger coils 31 and such water or other liquid is heated in direct proportion to the temperature maintained in the liquid filling the shell 10 by operation of the primary heat exchanger 21. The thus heated liquid in the secondary heat exchanger coils 31 is then circulated through the suit of a diver or divers and then is discharged from the suit or suits back into the sea. Any suitable pumping arrangement, not shown, such as a submersible pump or an on-board pump, may be used to maintain circulation of the sea water through the coils 31 in the described manner.

When the unit is employed for non-diver applications, the secondary heat exchangers 31 can be shut off or omitted entirely. Water or other suitable liquid in the shell 10 can be maintained at a proper level therein by conventional pumping means, not shown, and this liquid will be heated by the primary heat exchanger 21 and can be delivered in a closed loop system or systems to remote heat exchangers, such as radiators for heating a building or for other like purposes. Thus, the invention is versatile in its use capabilities as well as being simplified, substantially self-contained and efficient and economical in operation.

Figure 1:
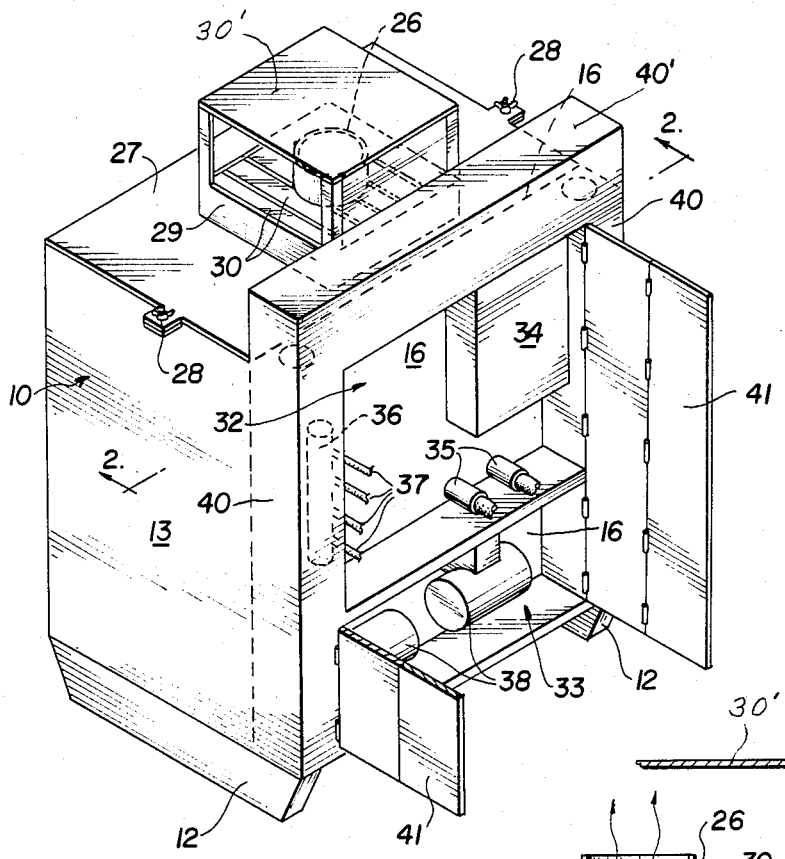
FIG. 1 is a front perspective view of a heating system for water or other liquid according to the present invention.

At the front of the rectangular unit, forwardly of the bulkhead 16, upper and lower dry service compartments 32 and 33, FIG. 1, are provided. Within the upper compartment 16 is an electrical control panel 34 for instrumentation including aquastat temperature controls and temperature gages, not shown. Also, in the compartment 16, are sea water strainers 35 through which incoming sea water must pass before being delivered to the secondary heat exchanger coils 31 as shown schematically in FIG. 4. The sea water heated within the coils 31 is delivered to a manifold 36 in the compartment 16 having several different delivery lines 37 through which warm water can be delivered to one or more divers through hoses of sufficient lengths. As previously, stated, the water after passing through the diver's suit is expelled back into the sea.

In the lower front compartment 33, twin oil or gas burner gun units 38 are fixed to mounting flanges 39 on the forward ends of short gun spacer pipes 39' which are attached to the forward vertical wall of the firebox 14, FIG. 3. The use of the spacer pipes 39' for mounting the fuel guns 38 prevents overheating of the fuel guns, as might occur if they were in direct thermal contact with the firebox. The narrow water space at the front of the firebox adjacent to the bulkhead 16 also keeps the temperature of the guns 38 within a safe range. The guns 38, which are conventional, deliver oil or other fuel directly into the combustion chamber defined by the firebox 14 where the fuel is ignited and burned.

On opposite sides of the two front compartments 32 and 33, built-in vertically elongated fuel storage tanks 40 extend from the top to the bottom of the shell 10. A connecting upper horizontal tank 40' extends between and communicates with the two vertical tanks 40 for added fuel storage capacity. Double folding doors 41 are provided to cover the compartments 32 and 33, and when opened these doors can fold flat against the fronts of tanks 40.

A single rear dry service compartment 42 having hinged doors 43 is recessed into the rear of the shell 10 and thus projects into the rear water chamber of the shell behind the firebox 14. Within opposite sides of the service compartment 42 can be installed forwardly projecting dual back-up electrical heating elements 44 for the diver application of the invention. These back-up heating elements assure sufficient heating of the fresh water or other liquid in the shell 10 for life support even in the event of complete failure of the primary heat exchanger 21 due to combustion failure in the firebox 14. In lieu of the electrical back-up elements 44, steam heated dual back-up elements, not shown, can be employed in some cases. It is also possible to provide a back-up emergency heating element, either steam or electric, across the rear liquid chamber of the shell 10 beneath the compartment 42 or at other locations in the shell. An electrical control panel 45 for electric heat sensors, not shown, aquastat temperature gages, etc. are provided in the rear service compartment 42.

Inasmuch as warmth is vital to the survival of divers, it may be seen that in addition to providing one or more back-up heating means within the shell 10 the invention throughout provides dual or redundant prime operating components including the dual burner guns 38, dual secondary heat exchangers 31, and dual back-up heating elements 44. The maximum safety of the diver relying on the heating system is thus assured.

When using solid fuel, the fuel gun mounting flanges 39 can be easily adapted to a solid fuel auger for automated feed, or replaced with a door arrangement to provide solid fuel and combustion air access to the firebox 14.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A water heater particularly for delivering warm water to the suits of divers in the sea, comprising a substantially rectangular upright shell adapted for placement on shipboard and adapted to be substantially filled with fresh water, said shell having an open top, a cover plate removably secured to the top of said shell and substantially covering the open top of the shell and having a substantially central sleeve extension rising from the cover plate, the cover plate having an opening registering with the lower end of the sleeve extension, a plurality of spaced horizontal splash plates fixed within the sleeve extension at an elevation somewhat above the top of the shell and said cover plate and serving to vent the interior of the shell to atmosphere, a fire box fixed within the bottom of the shell and being rectangular and having its vertical walls spaced from corresponding vertical walls of the shell and having a top wall disposed at an elevation within the shell substantially above the bottom wall of the shell, the fire box being adapted to be surrounded on all of its sides and at its top by fresh water contained within the shell, connecting means extending between a vertical wall of the firebox and a vertical wall of the shell and being in communication with said firebox, burner means mounted to said connecting means, a primary heat exchanger fixedly mounted on top of the fire box and including a multiplicity of vertical axis fire tubes rising above the top of the fire box and being disposed centrally in the shell and being adapted to be surrounded by fresh water in the shell, the fire box having a top opening in communication with bores of the fire tubes, an exhaust stack means mounted on the top of the primary heat exchanger within the upper portion of the shell and including a vertical axis exhaust stack extending above the elevation of said splash plates, the splash plates having an opening receiving the exhaust stack for venting exhaust gases and stabilizing said exhaust stack, a pair of parallel connected secondary heat exchangers within the shell near opposite vertical walls of the shell and being disposed on opposite sides of the fire box and primary heat exchanger in spaced relationship thereto, the secondary heat exchangers comprising banks of heat exchanger coils having their tops and bottoms spaced from the cover plate and bottom wall of the shell and extending vertically for the major portion of the combined height of the fire box and primary heat exchanger, sea water inlet and outlet connections with said secondary heat exchangers through one wall of the shell, whereby sea water can be pumped continuously through the secondary heat exchangers and delivered to the suit of a diver and then expelled from said suit into the sea, and emergency back-up heat exchanger elements penetrating into the interior of the shell through one wall thereof and being adapted to be surrounded by fresh water within the shell.

2. A water heater as defined in claim 1, and said emergency back up heat exchanger elements comprising banks of horizontal axis elements disposed in the shell adjacent to opposite sides of the primary heat exchanger and between the primary and secondary heat exchangers.

* * * * *